US005094275A

United States Patent [19]

Shaw et al.

[11] Patent Number: 5,094,275

[45] Date of Patent: Mar. 10, 1992

[54] WEFT STORING AND DELIVERING DEVICE WITH PNEUMATIC THREADER

[75] Inventors: Henry Shaw, Vleteren; Jo Tacq; Andre Vandeputte, both of Ieper, all of Belgium; Lars H. G. Tholander, Huskvarna, Sweden

[73] Assignee: Iro AB, Vistaholm, Sweden

[21] Appl. No.: 466,448

[22] Filed: May 18, 1990

[30] Foreign Application Priority Data

| | | | |
|---|---|---|---|
| Oct. 9, 1987 | [DE] | Fed. Rep. of Germany | 3734284 |
| Nov. 25, 1987 | [DE] | Fed. Rep. of Germany | 8712946[U] |
| Jan. 27, 1988 | [SE] | Sweden | 8800281 |

[51] Int. Cl.[5] ..... D03D 47/34

[52] U.S. Cl. ..... 139/452; 242/47.01

[58] Field of Search ..... 139/452; 242/47.01, 242/47.03

[56] References Cited

U.S. PATENT DOCUMENTS

| | | | |
|---|---|---|---|
| 4,102,362 | 7/1978 | Tojo | 139/452 X |
| 4,351,495 | 9/1982 | Lindstrom et al. . | |
| 4,658,866 | 4/1987 | Takegawa | 139/452 X |
| 4,756,341 | 7/1988 | Takehana . | |
| 4,832,091 | 5/1989 | Shaw | 139/452 X |

FOREIGN PATENT DOCUMENTS 177389 10/1976 Czechoslovakia .

*Primary Examiner*—Andrew M. Falik

[57] ABSTRACT

A yarn storing and delivering device for a weaving machine includes a stationary base body and a hollow shaft which is rotatably mounted in the base body and which carries a laterally projecting yarn feeder element. Yarn is guided into the hollow shaft and wound by the yarn feeder element onto a storing surface of a storing drum which is maintained stationary relative to the base body. The yarn is axially withdrawn from the storing drum over a free edge of the storing surface and through a substantially central guide opening. A threading device equipped with air jet nozzles is provided for automatically threading the yarn up to a location within the guide opening. The threading device includes a compressed air conveying system disposed between the guide opening and a location adjacent the outlet of the yarn feeder element. The compressed air conveying system includes a plurality of stationary directional jet nozzles which, when activated, provide an air flow which delivers the yarn to the guide opening.

24 Claims, 5 Drawing Sheets

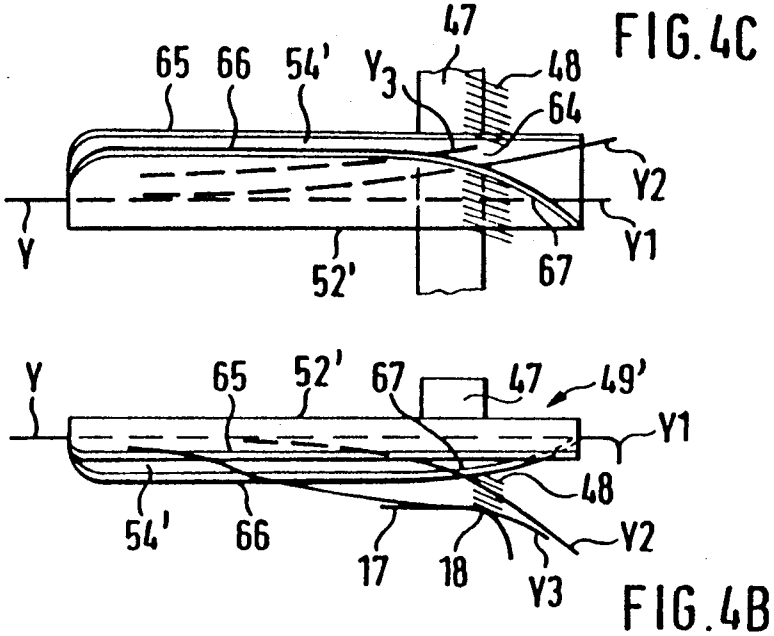
FIG. 4C
FIG. 4B
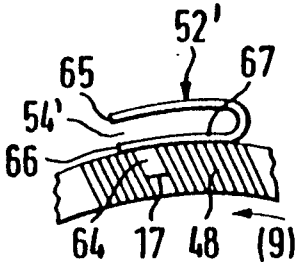
FIG. 4A
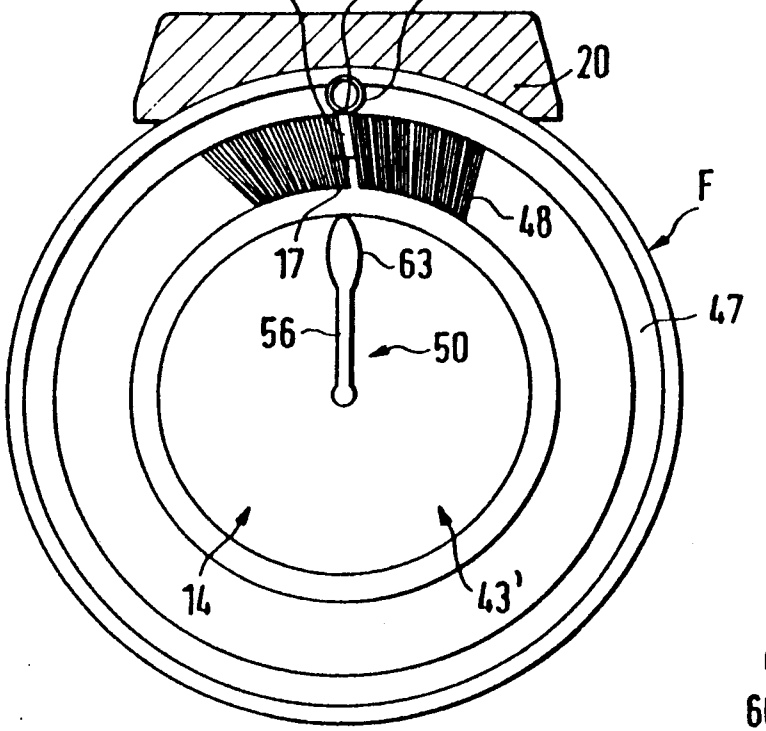
FIG. 3

WEFT STORING AND DELIVERING DEVICE WITH PNEUMATIC THREADER

FIELD OF THE INVENTION

The present invention relates to a yarn storing and delivering device for a weaving machine.

BACKGROUND OF THE INVENTION

Disclosed in EP-A 2 171 057 (corresponding to U.S. Pat. No. 4,658,866) is a known yarn storing and delivering device of open construction wherein the guide opening formed by the main jet inlet of a jet nozzle weaving machine is located at a relatively great axial distance from the storing drum, while the threading device comprises a suction pipe element having a nozzle portion adapted to swivel back and forth between the feeder element and the guide opening by means of a driving device. Mounted on the suction pipe element is a first yarn guide member cooperating with translational drive means. Contained within the suction pipe is a clamping device. Disposed between the storing drum and the guide opening in coaxial alignment with the latter is a second yarn guide member in the form of an axially movable blowing nozzle in combination with yarn clamps and scissors and drive elements for these components. The suction pipe element receives the yarn from the feeder element and clamps the yarn, whereupon it is swivelled towards the guide opening. In the meantime a yarn supply is wound onto the storing drum, before the first guide member brings the yarn into the path of the second guide member operable to supply the yarn to the guide opening after a section thereof has been cut off to remain in the suction pipe element. A disadvantage of this known device is the rather expensive construction of the threading device, its complicated control mechanism and the large space required for mounting the individual components, so that this principle is unsuitable for a substantially closed construction of a device of this type, in which the guide opening is located close to the storing drum. Particularly difficult is the disposition and actuation of the second guide member within the balloon of the outgoing yarn during normal operation. There is a considerable danger of malfunction, because the threading operation is carried out in several steps independent from one another.

In a yarn storing and delivering device known from EP-A 2 811 04859 (corresponding to U.S. Pat. No. 4,378,821) the threading operation is carried out manually with the aid of a wire.

It is an object of the invention to provide a yarn storing and delivering device of the type defined in the introduction, which is characterized by a reliably operable and compact threading device of simple construction and devoid of any components to be moved for the threading operation.

This object is attained according to the invention by the characteristics set forth below.

SUMMARY OF THE INVENTION

The supply of compressed air to stationary directional jet nozzles alone results in the generation of an air flow effective to pick up the yarn in case it has been broken and to supply it directly to the guide opening. The supply of compressed air to the directional jet nozzles may be simultaneous and over an extended period of time to thereby generate a substantially stable air flow towards the guide opening, or sequentially for passing the yarn from the air jet of one directional jet nozzle on to the next air jet, or it may be in the form of compressed air pulses of longer or shorter duration for a step-wise advance of the yarn towards the guide opening. The blowing direction of the directional jet nozzles is selected so that the yarn leaving the feeder element does not again leave the air flow. The conveying path of the yarn towards the guide opening does not contain any noticeable obstacles, so that the yarn will rapidly and accurately find its destination without requiring any mechanical auxiliary elements. The threading operation is thus not influenced by the storing drum or any elements associated therewith for the operation of the storing device proper. On the other hand, the components of the threading device do not interfere with the normal operation of the yarn storing and delivering device. Even existing storing devices can be converted to the automatic threading operation by simple and inexpensive structural modification.

BRIEF DESCRIPTION OF THE DRAWINGS

In the attached drawings:

FIG. 3 shows a sectional view taken in the plane III—III of FIG. 2, FIG. 4 shows a detail modification of FIGS. 2 and 3 in three complementary views.

DETAILED DESCRIPTION

Figure 1:
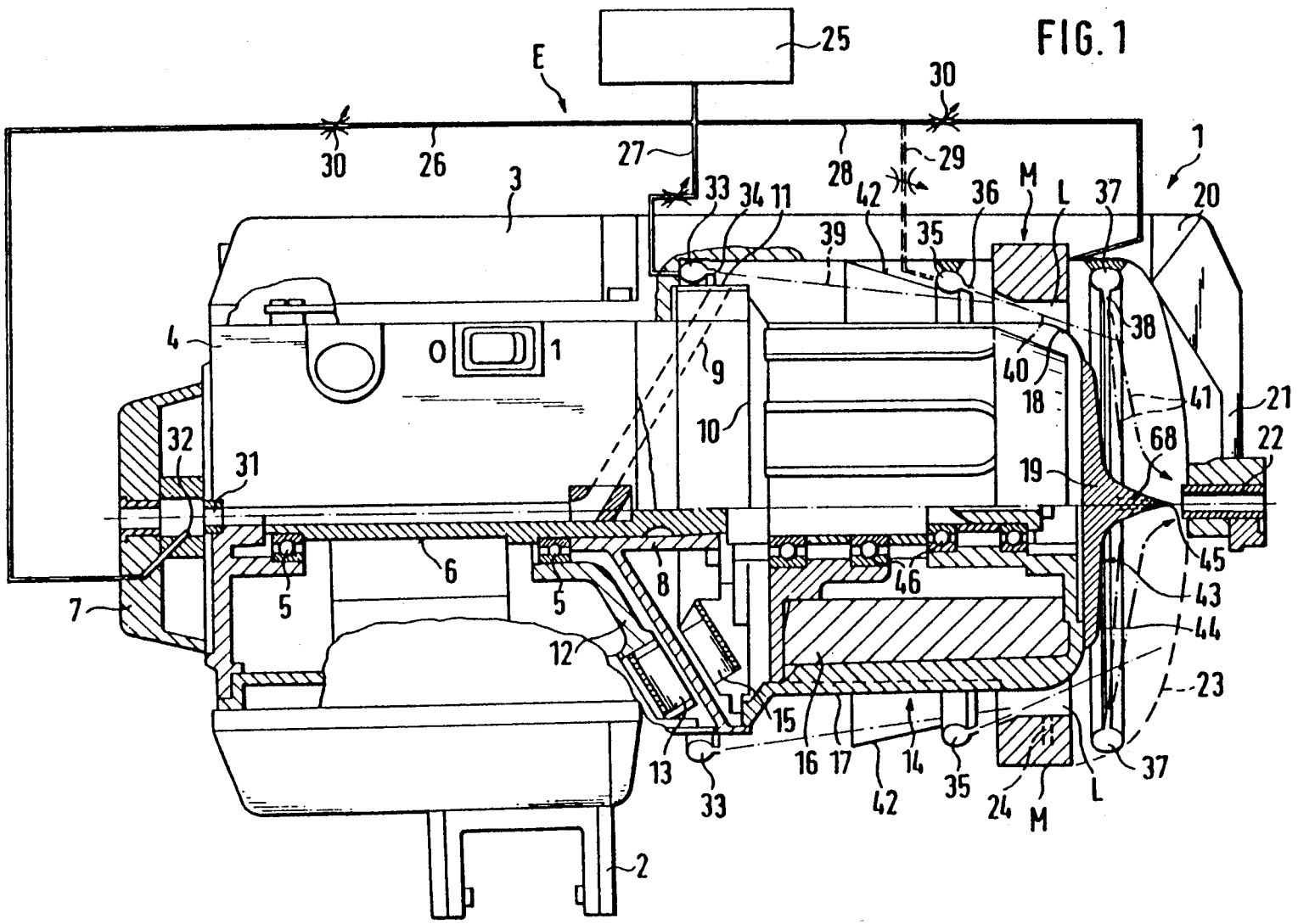
FIG. 1 shows a diagrammatical longitudinal sectional view of a yarn storing and delivering device according to a first embodiment of the invention.

In one embodiment of the invention, a circumferential air gap is defined between the storing surface and a device surrounding the storing drum at a distance, for instance a yarn withdrawal measuring apparatus. A yarn storing and delivering device of this type conceived for a jet nozzle loom is described in EP-A 2 107 110, which is incorporated herein by reference. In this embodiment of the subject matter of the invention, the circumferentially continuous air curtain always results in an air flow effective to advance the yarn leaving the feeder element towards the guide opening, and that advantageously completely independent of the angular position at which the feeder element is stopped after the breaking of the yarn. This offers the advantage that the device does not require any additional components for stopping the feeder element at a predetermined angular position, and that the feeder element does not have to be brought to any such position, instead of which it is possible to start the automatic yarn threading operation immediately after breaking of the yarn. The stationary annular jet nozzle bodies generate a uniform air flow and can be readily incorporated in the stationary portion of the yarn storing and delivering device.

A further advantageous embodiment, a circumferentially continuous nozzle slot or circumferential rows of nozzle openings generate a very uniform air curtain as required for effectively advancing the yarn. Within the air curtain it is possible to obtain a substantially laminar flow in which the directional flow forces act on the yarn in an efficient manner.

In a further advantageous embodiment, the guide surface at the head portion of the storing drum is effective to guide the air flow, and when present also the yarn, towards the guide opening, because the flow adheres to the guide surface to be guided therealong.

One configuration of the guide surface permits a flow guidance of considerable length to be obtained, and that independent of the angular position of the stopped feeder element after yarn breakage. A concave configuration of the guide surface rising towards an apex point is effective to guide the air flow and the yarn towards the guide opening in a particularly accurate manner.

A further guide surface is particularly effective to guide the air flow and the yarn as the distance from the directional jet nozzle increases.

The disclosed distribution of the annular jet nozzle bodies is effective to ensure the reliable advance of the yarn towards the guide opening with a relatively small amount of compressed air, because the air jet of the second annular jet nozzle body impinges on the yarn as it is redirected towards the guide opening at a location whereat the conveying effect of the air jet of the first annular jet nozzle body may become insufficient.

In a further advantageous embodiment, a circumferential air gap is again defined between the storing surface and a device surrounding the storing drum at a distance, for instance a yarn withdrawal measuring apparatus. In this embodiment the yarn is again immediately advanced towards the guide opening after a yarn breakage independently of the angular position of the stopped feeder element. In this embodiment a circumferential air curtain is not formed adjacent the outlet of the feeder element, instead of which the stationary directional jet nozzle associated to the feeder element is supplied with compressed air from the stationary annular jet nozzle body associated to the base body to thereby generate an axially directed air jet exiting from its nozzle opening at the very location whereat the yarn exits from the feeder element. The cylindrical sealing ring formed with an opening only adjacent the inlet of the directional jet nozzle is effective to close the circumferentially extending outlet slot of the annular jet nozzle body, so that an effective air jet is generated with a relatively small amount of compressed air. The jet nozzles do not interfere with the normal operation of the yarn storing and delivering device, because the annular nozzle body does not directly contact the directional jet nozzle.

In another embodiment there is provided a further annular jet nozzle body the air curtain of which is effective to aid the conveyance of the yarn as it is passed through the possibly critical portion of the air gap. This embodiment would be particularly advantageous for yarn storing and delivering devices of a more bulky construction. It is possible to provide a plurality of annular jet nozzle bodies both between the outlet of the feeder element and the measuring apparatus and between the measuring apparatus and the guide opening, so that their respective air curtains cooperate with one another in series, to which purpose the thus provided annular jet nozzle bodies may be consecutively supplied with compressed air.

There is a further advantageous embodiment of the subject matter of the invention, comprising means for stopping the feeder element always at the same predetermined angular position. Inasmuch as in this embodiment the feeder element is always stopped at the same angular position after occurrence of yarn breakage, the conveying system generates the air flow required for advancing the yarn towards the guide opening only at the respective longitudinally extending portion of the yarn storing and delivering device. The individual jet nozzles require only a small supply of compressed air; the compressed air may selectively be supplied continuously and simultaneously, sequentially, or in the form of compressed-air pulses.

In this context a two-part guide channel disposed at the longitudinal location determined by the stopping position of the feeder element is effective to guide the air flow and thus the advance of the yarn. Since at least the first portion of the guide channel has an open side, the yarn supplied to the guide opening can drop from the guide channel onto the storing surface, or be pulled thereonto, without exterior aid after completion of the threading operation.

In a particularly simple embodiment, a longitudinally slotted tube ensures a reliable flow and yarn guidance in the first portion of the guide channel. The longitudinal slot permits the newly threaded yarn to pass onto the storing surface without any obstruction, so that the subsequent winding of the yarn onto the storing surface is not interfered with. The longitudinal slot of the tube may be closed by an elastic lip which prevents the yarn from dropping through the slot. It will be sufficient to thus close only a lower part of the slot adjacent the outlet of the feeder element. The lip is secured to the tube adjacent one edge of the slot, e.g. the rear edge thereof as seen in the direction of rotation of the feeder element.

In an alternative embodiment, the yarn and also the air flow are already deflected in a bent end portion of the tube towards the guide opening without the danger of obstruction by turbulences or of the yarn getting hung up. The tube is mainly effective to guide the air flow without the yarn coming necessarily in contact with the tube wall. The bent tube offers the further advantage that the conveyed yarn already exits from the longitudinal slot in a chord configuration as it is being advanced towards the guide opening.

In a further alternative embodiment, the yarn is initially safely guided within a sleeve, until the leading yarn end has reached the end of the sleeve and is deflected in a substantially radial direction towards the guide opening. Only thereafter the tension force acting on the yarn will cause the yarn to exit from the sleeve along the yarn deflecting surface and to thus gradually leave the longitudinal slot of the sleeve, so that the yarn has substantially completely left the sleeve and is supported on the storing surface as soon as the leading end of the yarn has entered the guide opening.

The invention insures the reliable entry of the yarn into the tube or the sleeve, respectively, with the additional effect that the air flow is constricted and thereby accelerated to exert an increasing conveying force on the yarn adjacent the inlet of the tube or the sleeve, respectively.

In a further important embodiment, adjacent the free edge of the storing surface there is provided a yarn braking ring engaging the storing drum by means of resilient braking elements. In yarn storing and delivering devices for use for instance in conventional weaving machines of the shuttle-free type, the threading of the yarn is rendered difficult by the yarn braking ring constituting an obstacle in the conveying path towards the guide opening. Due to the provision, however, of this embodiment, that the first portion of the guide channel extends axially through the yarn braking ring, the latter does no longer form an obstacle in the conveying path towards the guide opening. The circumferential gap between the braking elements aligned with the open side of the guide channel is effective to ensure that the yarn passes immediately onto the storing surface, or onto the free edge of the storing surface, respectively, as it leaves the first portion of the guide channel and is immediately pulled to a position underneath the braking elements by a subsequent winding operation to thereby ensure the exertion thereon of the braking action between the braking elements and the free edge of the storing surface as required for the proper winding operation. The circumferential gap between the braking elements needs to be only slightly greater than the thickness of the yarn, to thereby ensure that the high circumferential speed of the contact point between the yarn and the free edge of the storing surface causes the braking elements to be deformed to such a degree that they generate a substantially uniform braking action for the yarn in the circumferential direction, which is of particular importance for the normal operation of the yarn storing and delivering device. The circumferential gap between the braking elements may for instance only be formed in a radially outer portion of the braking ring, while the braking elements are in continuous contact with the free edge of the storing surface. In this case the yarn exiting from the longitudinal slot of the guide channel is gripped between the brake elements with a sufficient force for permitting a yarn supply to be wound onto the storing surface. The yarn will then only gradually pass onto the withdrawal edge and under the points of the brake elements, from underneath which it is then withdrawn during normal operation of the device.

From DE-PS 29 32 782 (ccrresponding to U.S. Pat. No. 4,351,495) it is as a matter of fact known to provide a yarn storing and delivering device for weaving machines with a stationary guide channel from the outlet of the feeder element to the guide opening. This guide channel is only used, however, for guiding and bending a threading needle during a manual yarn threading operation.

In another advantageous embodiment, a yarn braking ring is provided with resilient brake elements adapted to engage the storing drum, the threading operation requires the yarn braking ring to be displaced in such a manner that the brake elements open a gap for the yarn to pass readily therethrough. After the threading operation the brake elements are re-engaged. The movement of the yarn braking ring may be controlled by means of magnets or a pneumatic device. It would also be imaginable to displace only the brake elements at the circumferential location of the feeder element to thereby temporarily form an open passage, by the use for instance of a tiltable section of the braking ring.

A further important embodiment, includes a radial channel, which may for instance be constricted to a narrow gap adjacent the edge portion, and wherein the air flow is effective to convey the yarn quickly and accurately towards the guide opening, the accurately directed guidance of the yarn towards the guide opening being additionally ensured by a funnel-shaped inlet portion and the gradual transition towards the guide opening. The radial channel does not interfere with the normal operation of the device, because the yarn is usually withdrawn in the form of a balloon extending outwards of the channel. If the edge portion of the channel is restricted, it results in improved flow guidance in the channel towards the guide opening. The restricted edge portion nevertheless permits the yarn to be lifted from the channel after having reached the guide opening, so as to be free for a subsequent winding operation.

With some of the embodiments disclosed it could be advantageous for the function to provide across the open side of the guiding channel for the yarn, a e.g. resilient, lip, flap or bristles which cover the open side of the guiding channel and prevent the too early exit of the yarn, a sideward leaking of the pressurized air while allowing a sidewardly pulling out of the yarn as soon as it is under tension. Said lip, flap or said bristles are inclined in a direction in which the winding on member rotates during normal operation, i.e. approximately tangential to the periphery of the storing drum. Said lip, flap or said bristles can be provided in the axial portion of the guiding channel as well as in the head portion of the storing drum across the radial extending part of the guiding channel. For example, said lip, flap or said bristles could be provided on the outer side of the tube in the region of the trailing edge of the slot of said tube, seen in the rotational direction of the winding on member. As soon as the winding on member starts to wind on yarn again on the surface of the storage drum, the yarn will be pulled out through the slot and the open side of the guide channel against the resistance of the braking ring or the holding force in the guiding opening at the withdrawal end of the feeding device. Additionally, said lip, flat or said bristles ensure due to their position, that during normal operation the yarn cannot be caught by the edge of the open side of the guiding channel.

In one advantageous embodiment, the channel practically circumvents the brake elements, so that the yarn does not collide with the brake elements as it enters the inlet portion. In this case the inlet portion may be formed with oblique surfaces for facilitating the subsequent lifting of the yarn out of the channel.

Of further advantage is an embodiment, wherein two directional jet nozzles act on the yarn at locations whereat it has to be deflected, namely, at the outlet of the feeder element and at the transition from the axial to the radial conveying direction, an effective and rapid conveyance is achieved with relatively small amounts of compressed air.

In another embodiment, an individual auxiliary jet nozzle facilitates the deflection of the yarn from the substantially axial conveying direction to the radial conveying direction, before the radial directional jet nozzle becomes effective to convey the yarn further towards the guide opening. The individual auxiliary jet nozzle may be formed as a structural unit with the adjacent directional jet nozzle, and may also be supplied with compressed air in unison therewith.

A further advantageous aspect is a jet nozzle directed towards the guide opening and effective to accurately advance the arriving yarn into the guide opening or even through the guide opening, to thereby conclude the threading operation. The jet nozzle disposed in the head portion may be supplied with compressed air through the storing drum and the hollow shaft. It is also imaginable that compressed air is injected for the threading operation through a lateral opening in the storing surface to be supplied from there to the jet nozzle in the head portion.

A further particularly advantageous feature is a suction nozzle is effective to pull the yarn arriving at the guide opening rapidly through the guide opening. This nozzle is preferably supplied with compressed air in the same manner as the other directional jet nozzles to operate as an injector suction nozzle for generating the desired directional suction force.

Finally the invention permits individual adjustment of the intensity of the air jets by the employ of pressure or flow control valves in the case of compressed-air supply to all of the various jet nozzles from a common compressed-air source. It is obvious that the stationary directional jet nozzles may have their position and orientation individually adjusted, so that the threading system may be adapted to different types of yarn. The compressed-air source (e.g. a compressor) is preferably operatively connected to a yarn breakage sensor or with a control device connected to such breakage sensor and operable to stop operation of the device. In this manner the threading operation can be initiated immediately after the feeder element has been stopped, so as to keep the downtime of the yarn storing and delivering device as short as possible.

FIG. 1 shows a yarn storing and delivering device 1 for supplying yarn sections of accurately metered length to a loom (not shown) Device 1 comprises a stationary base body including a mounting portion 2 and formed as a drive housing of a driving motor 4 having a hollow output shaft 6 rotatably mounted in bearings 5 of the base body. Mounting portion 2 permits device 1 to be mounted on the frame (not shown) of a loom. Secured to the inlet end portion of base body 3 is a stationary cover 7. Non-rotatably mounted on hollow shaft 6 is a sleeve 8 carrying a ring 10 disposed concentrically about the longitudinal axis of base body 3. A channel-shaped feeder element 9 extends from hollow shaft 6 to an outwards opening outlet 11. Housed in a portion 12 fixedly connected to base body 3 are permanent magnets 13 in alignment with permanent magnets 15 fixedly mounted in a storing drum 14 coaxially surrounding hollow shaft 6. Contained within storing drum 14 is a filler body 16. The outer surface of storing drum 14 constitutes a storing surface 17 having a substantially axially extending generatrix. Storing surface 17 extends to a convex rounded free edge 18 (withdrawal edge) forming a transition to an end cover 19 of storing drum 14.

Extending from base body 3 substantially parallel to its longitudinal axis is a rigid arm 20 having a radial end portion 21 for carrying a guide opening 22 aligned in the present case with the longitudinal axis of device 1. Guide opening 22 may be formed as a closed or slotted yarn eyelet or as the inlet of the main jet nozzle (not shown) of a loom. Shown in dotted lines is a closure cover 23 (balloon limiter) which may be provided for covering the end of device 1.

Adjacent free edge 18 storing surface 17 is surrounded by a yarn withdrawal length measuring device M containing a sensor, not shown in detail, for sensing the passage of the yarn as it is being withdrawn, and a stopping device for stopping the yarn after a predetermined length thereof has been withdrawn (diagrammatically indicated at 24). Details of the construction of a measuring device M of this type and of its operation are set conventional forth in EP-A 2 107 110. Measuring device M extends opposite free edge 18 in spaced relation therewith so as to define a circumferential air gap L having a width of for instance 6 mm.

The yarn storing and delivering device of FIG. 1 includes a compressed-air conveying system E for threading the yarn after a yarn breakage by means of an air flow effective to convey the yarn end exiting from outlet 11 towards guide opening 22. Compressed-air conveying system E includes a compressed-air source 25, for instance a compressor or a compressed-air reservoir, communicating with directional jet nozzles via supply tubings 26, 27, 28 and 29 individually provided with flow or pressure control valves 30. Tubing 26 leads to a jet nozzle 32 within cover 7. Jet nozzle 32 is directed into an inlet 31 of hollow shaft 6 for advancing the yarn through hollow shaft 6 and feeder element 9 to outlet 11.

Fixedly disposed at the side of outlet 11 facing away from storing drum 14 is an annular jet nozzle body 33 communicating with tubing 27 and concentrically surrounding ring 10. Nozzle body 33 has a circumferentially extending slot nozzle 34 the blowing direction of which is substantially axial. When supplied with compressed air, annular jet nozzle body 33 generates a circumferentially extending, slightly conical air curtain 39 directed into air gap L and converging slightly in the direction towards guide opening 22.

Disposed adjacent measuring device M is a further stationary annular jet nozzle body 35 having a circumferentially extending slot nozzle 36 for forming an air curtain 40 directed into air gap L when supplied with compressed air. A further stationary annular jet nozzle body 37 is finally disposed adjacent the other side of measuring device M and formed with a circumferentially extending slot nozzle 38 substantially aligned in the radial direction for generating an air curtain 41 when supplied with compressed air. If the air curtain 39 generated by annular jet nozzle body 33 is sufficiently strong, annular jet nozzle body 35 may be omitted, this case being indicated by the dotted supply tubing 29. A guide surface 42 aids in guiding air curtain 39 towards air gap L.

A head portion 43 of storing drum 14 is formed with a guide surface 44 for guiding air curtain 41 and the yarn conveyed thereby towards guide opening 22. Guide surface 44 is of rotation-symmetric shape with respect to the axis of storing drum 14 and rises gradually radially inwards to subsequently rise via a concave transition towards a central apex 45 directed into guide opening 22. At this location there may be provided a further jet nozzle 68 connected in a manner not shown to compressed-air source 25 or to another compressed air source for generating an air jet directed into guide opening 22.

By means of bearing 46 storage drum 14 is rotatably mounted on an extension of hollow shaft 6, so that it is kept stationary with respect to base body 3 by the cooperation of permanent magnets 13 and 15 as hollow shaft 6 is rotated.

Figure 7:
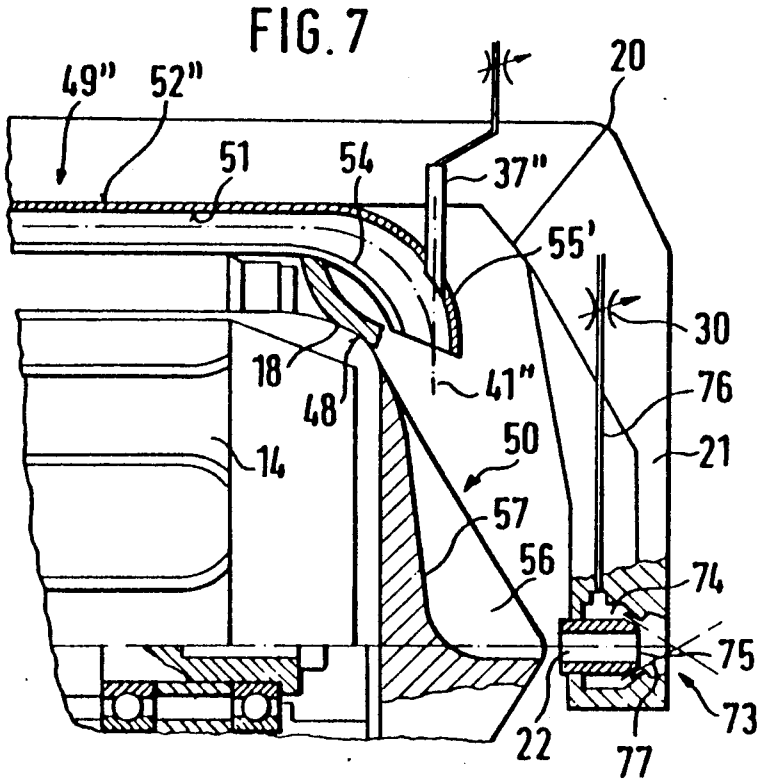
FIG. 7 shows a detail of a modification of the embodiment of FIGS. 2 and 3.

The yarn storing and delivering device of FIG. 1 normally operates in the conventional manner not concerned by the present invention, so that only the automatic yarn-threading operation shall be described in detail. After a yarn breakage or when a yarn is to be threaded for the first time, the respective yarn is supplied to the inlet opening 31 of hollow shaft 6 by any suitable means. Compressed air is supplied from source 25 via supply tubing 26 to jet nozzle 32 to thereby advance the yarn through hollow shaft 6 and feeder element 9 to the outlet 11 thereof. Irrespective of the angular position at which feeder element 9 has been stopped after the yarn breakage, the end of the yarn exiting from outlet 11 enters the air curtain 39 generated by annular jet nozzle body 33 supplied with compressed air via supply tubing 27. Air curtain 39 is effective to entrain the yarn as it passes through air gap L. Annular jet nozzle body 35, if provided, will then be operated to advance the yarn at the inlet side of air gap L. After passing air gap L, the yarn and air curtain 39 or 40, respectively, the intensity of which has already decreased, enter the air curtain 41 generated by annular jet nozzle body 37 supplied with compressed air via supply tubing 28. Air curtain 41 is guided along guide surface 44 to convey the yarn towards guide opening 22, whereat the passage of the yarn through guide opening 22 may be aided by an air jet from nozzle 68. In an advantageous embodiment as shown in FIG. 7, guide opening 22 may be provided with a suction nozzle to thereby ensure that air curtain 41 properly enters guide opening 22 with the yarn entrained thereby. The rotation-symmetric guide surface 44 ensures the proper conveyance of the yarn into the guide opening 22 irrespective of the angular position of feeder element 9. The individual jet nozzles may be supplied with compressed air simultaneously or sequentially, also conceivable is the supply of compressed air in the form of successive pulses, whereby the yarn is advanced towards guide opening 22 in successive steps. The yarn exiting from guide opening 22 is taken over by not shown conveying means. The supply of compressed air to the jet nozzles may then be stopped, so that the tension force acting on the yarn through guide opening 22 causes the yarn to come into contact with the free edge 18 of storing surface 17. The driving motor 4 may then by operated to rotate feeder element 9 for winding a yarn supply (cf. FIG. 5) onto storing surface 17, so that the yarn storing and delivering device 1 is again ready for normal operation.

Figure 2:
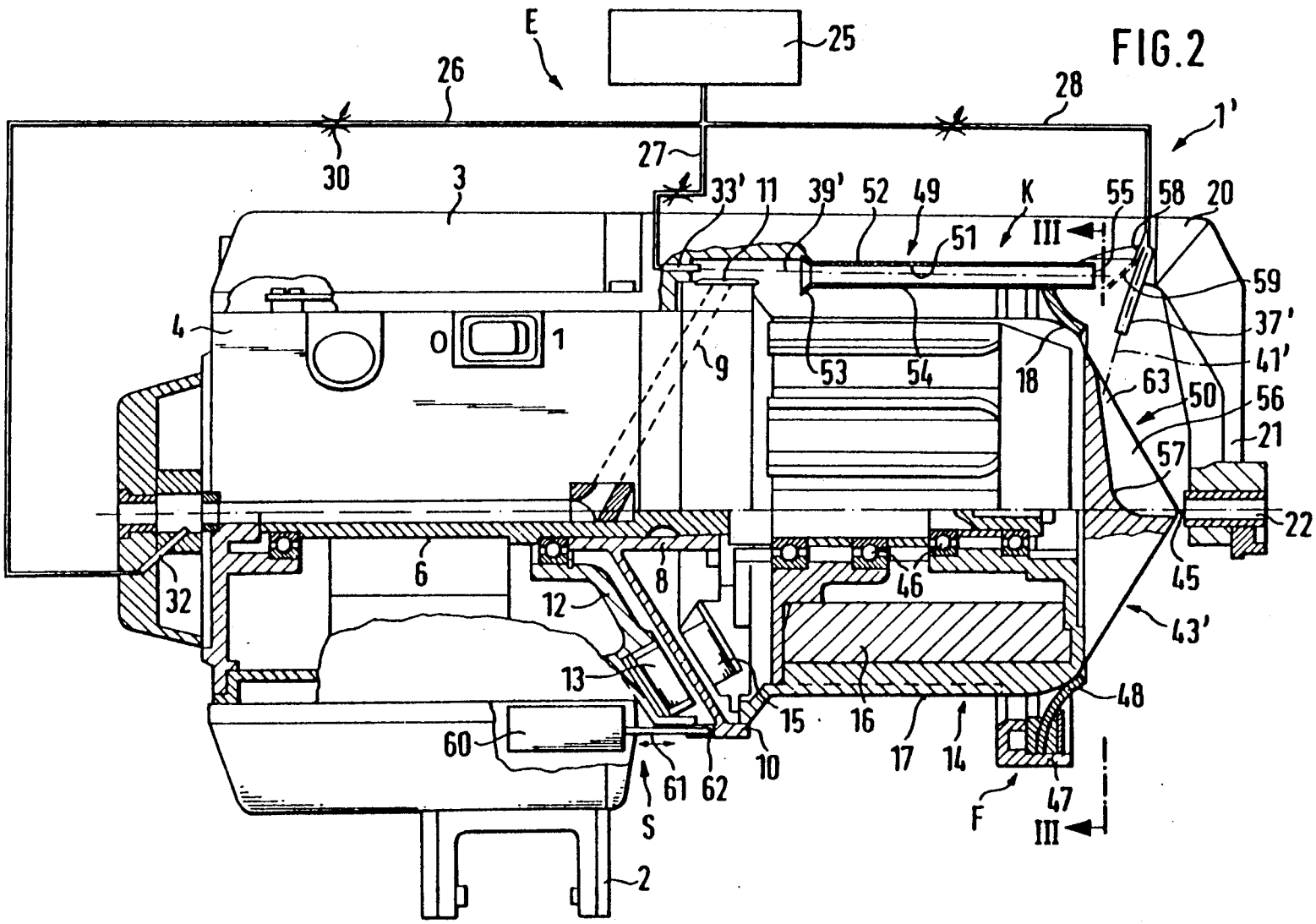
FIG. 2 shows a longitudinal sectional view of a second embodiment, without a yarn.

The embodiment of the yarn storing and delivering device 1' according to FIG. 2 is to a large extent basically similar to the one described above, wherefore similar or equivalent structural components are designated by the same reference numerals as in FIG. 1. The yarn storing and delivering device 1' is for instance intended for the supply of a conventional weaving machine operating without shuttles and essentially requiring a uniform and constant yarn withdrawal tension.

To this purpose the yarn length measuring device M shown in FIG. 1 is replaced by a so-called yarn braking ring F associated to the free edge 18 of storing surface 17 and secured to arm 20 itself connected to base body 3. Yarn braking ring F consists of an annular body 47 with a plurality of brake elements 48 in the form for instance of bristles projecting therefrom so as to resiliently engage free edge 18.

The yarn storing and delivering device 1' according to FIG. 2 is likewise equipped with a compressed-air conveying system E, including the jet nozzle 32 supplied with compressed air via supply tubing 26 and valve 30 for conveying the yarn through hollow shaft 6 and feeder element 9. Disposed at the side of outlet 11 facing away from storing drum 14 is a directional jet nozzle 33' connected to supply tubing 27. Fixedly disposed in arm 20 and associated to head portion 43' of storing drum 14 is a further directional jet nozzle 37' together with an auxiliary jet nozzle 58. System E further includes a guide channel K consisting of two portions 49 and 50 and serving for accurately directing the air jet from directional jet nozzle 33' and the air jet from directional jet nozzle 37' towards the guide opening.

The first portion 49 of guide channel K is formed by a tube 52 having an inlet funnel 53 and a longitudinal slot 54 facing towards storing surface 17 in a radial direction. Longitudinal slot 54 extends over the full length of tube 52. Tube 52 defines a guide surface 51 for the air jet 39' exiting from directional jet nozzle 33' directed substantially parallel to the longitudinal axis of storing drum 14 and into tube 52. Tube 52 extends axially through yarn braking ring F, so that its end portion 55 opposite inlet funnel 53 is located at the side of yarn braking ring F facing away from outlet 11. On the outer side of tube 52 the longitudinal slot 54 may be covered by a resilient lip extending at least along a lower portion of slot 54 adjacent funnel 53. This lip would be secured to tube 52 adjacent the rear edge of slot 54 as seen in the direction of rotation of feeder element 9. The lip prevents the yarn from dropping through slot 54 before it has reached guide opening 22. Only at this time or somewhat later, and as soon as a pulling force starts to act on the threaded yarn, this pulling force acts to deform the lip, so that the yarn can leave tube 52.

The second portion 55 of guide channel K is formed by a radially extending channel 56 in head portion 43' of storing drum 14 defining a radially extending guide surface 57 having a slightly rising first section and a rounded transition directed towards guide opening 22. The air jet 41' of directional jet nozzle 37' is directed into channel 56. Auxiliary jet nozzle 58 is supplied with compressed air together with directional jet nozzle 37' through supply tubing 28 and valve 30, and is directed substantially transversely over the end 55 of tube 52 for immediately directing the yarn exiting from tube 52 towards second portion 50 of guide channel K.

A device S is provided for stopping feeder element 9, after a yarn breakage has occurred, in alignment with a predetermined longitudinally extending section of device 1' to thereby ensure that the stationary directional jet nozzles and the guide channel are aligned with outlet 11 of feeder element 9. In the present example device S comprises a solenoid 60 the armature of which cooperates with an axially displaceable stopper pin 61 adapted to engage a recess 62 formed in ring 10. In the case of a yarn breakage, drive motor 4 operates to rotate ring 10 at a slow speed, while solenoid 60 extends locking pin 61 until it drops into recess 62 to stop ring 10 in a position (FIG. 2) in which outlet 11 is accurately aligned with the air jet exiting from directional jet nozzle 33'.

In the sectional view of FIG. 3 it is shown that the radial channel 56 provided in head portion 43' and forming the second portion 50 of guide channel K has a funnel-shaped inlet section 63 for reliably catching the yarn blown into channel 56 by directional Jet nozzle 37' to be subsequently guided towards guide opening 22.

Also shown in FIG. 3 is the manner in which tube 52 extends through annular body 47 of yarn braking ring F with its longitudinal slot 54 facing radially towards storing surface 17. At least in the vicinity of longitudinal slot 54 the yarn brake elements 48 define a circumferential gap 64 permitting the yarn exiting from the longitudinal slot 54 to be readily brought into engagement with the free edge 18 of storing surface 17.

The circumferential gap 64 shown in FIG. 3 is of exaggerated width. It is fully sufficient if there is adequate space below the longitudinal slot 54 for permitting the yarn to be withdrawn from tube 52 at this location.

In the embodiment of FIGS. 2 and 3 the tube 52 mainly serves the purpose of directing the air jet 39' and the yarn entrained thereby in the axial direction to a location whereat the air jet 59 generated by auxiliary jet nozzle 58 starts to act thereon. As soon as this air jet 59 and subsequently air jet 41' act on the yarn, the yarn is deflected and conveyed by the action of a steady pulling force towards guide opening 22. This pulling force is effective to gradually pull the yarn outwards through longitudinal slot 54 of tube 52 and through the circumferential gap 64 between the brake elements 48 into engagement with the free edge 18 of storing surface 17. When the yarn has thus reached guide opening 22, it has completely left tube 52 and has also been lifted out of channel 56. When motor 4 is subsequently activated, the braking action exerted on the yarn by brake elements 48 and free edge 18 is sufficient for permitting feeder element 9 to wind a yarn supply onto storing surface 17 without pulling the yarn back through guide opening 22. Prior to this time, the yarn end exiting from guide opening 22 has in any case been gripped by not shown elements for the further advance of the yarn. Prior to activation of motor 4 solenoid 60 has been operated to retract stopper pin 61, permitting ring 10 to be freely rotated. The compressed-air source 25 has likewise been deactivated at this time.

Diagrammatically shown in FIG. 4 is a modified detail of first channel portion 49'. The tube 52 is replaced by a stationary sleeve 52' having a longitudinal slot 54' opening in a substantially tangential direction with respect to storing surface 17 in the direction of rotation of feeder element 9. The edge 65 of longitudinal slot 57' facing away from storing surface 17 is of substantially rectilinear shape. The edge 66 of the longitudinal slot extending closer to storing surface 17 has its end portion formed as a yarn deflecting surface 67 of obliquely extending or arcuate configuration, so that the yarn initially conveyed rectilinearly through sleeve 52' by air jet 39' exits from the sleeve at a location Y1 to be subsequently acted on by air jet 59. The subsequent deflection of yarn Y and the pulling force acting thereon cause the yarn Y to be laterally displaced along yarn deflecting surface 67 to the position Y2. Continued pulling force will then cause the yarn to be completely withdrawn from longitudinal slot 54' via the position indicated at Y3. This displacement of yarn Y is facilitated by the convex arcuate shape of the sidewall of sleeve 52' facing towards brake elements 48. The circumferential gap 54 between the brake elements 48 is aligned with the yarn deflecting surface 67 in such a manner that the yarn is accurately guided into the circumferential gap 64 and thus onto storing surface 17. The sleeve 52' offers the advantage that the yarn is more reliably guided through the yarn braking ring body 47, because the sleeve 52' offers a continuous guide surface for the air flow and the yarn at the location of the yarn braking ring. It would also be sufficient to provide a widened plate member as a sidewall of sleeve 52' at the location of the yarn braking ring to thereby ensure the passage of the free end of the yarn past the brake elements, in which case the yarn deflecting surface 67 ensures that the yarn is reliably withdrawn from the mouth of the sleeve 52' by an increasing pulling force acting on the yarn.

In an alternative embodiment (not shown) the yarn braking ring F may for instance be mounted for axial displacement along arm 20, permitting the brake elements 48 to be lifted off the edge 18 to thereby open a gap for the yarn to pass therethrough as it is being threaded. The displacement of the braking ring may be controlled by pneumatic of magnetic means or in any other manner. It would also be conceivable to swivel only a few brake elements 48 out of the way for opening a passage for the yarn, and to subsequently return the brake elements to their original position, so that there is no interruption of the brake elements 48 during normal operation of the device. In both cases the transition of the yarn from the first portion into the second portion of the guide channel can be achieved in a particularly simple manner.

In another alternative embodiment shown in FIG. 7, the channel 56 could be of greater depth, and the inlet end 63 could be displaced in the direction towards feeder element 9, so that the inlet 63 would be placed on this side of the brake elements 48, so that the yarn passes directly from the first portion into the second portion of the guide channel. In this case the inlet 63 might be formed as an oblique slot, so that the yarn can be readily lifted or guided out of the slot after the threading operation, and so that the slot does not form any noticeable unevenness in the free edge which might otherwise interfere with the circulation of the yarn during normal operation.

Both channel parts (49, 50) of each described embodiment can be covered at their open sides by, e.g. resilient lips, flaps or bristles which prevent the too early exit of the yarn, a sideward leaking of the pressurized air but allow pulling out of the yarn after the threading-up step without problems. Said lip, flap or said bristles could extend across slot (54) on the outside of tube (52) and over groove (56). Suitably said lip, flap or said bristles are secured to the trailing edge of said slot (54) or said groove (56), seen in the direction of the rotation of the winding on member (9) FIG. 2. Said lip, flap or said bristles extend approximately tangentially with respect to the surface of the storage drum, also in its head portion, and in the direction of rotation of the winding-on member. Said lip, flap or said bristles furthermore enhance the reliability of the device, since they hinder the yarn during normal operation of the device against hooking to the otherwise free edge at the open side of the parts of the guiding channel.

Figure 5:
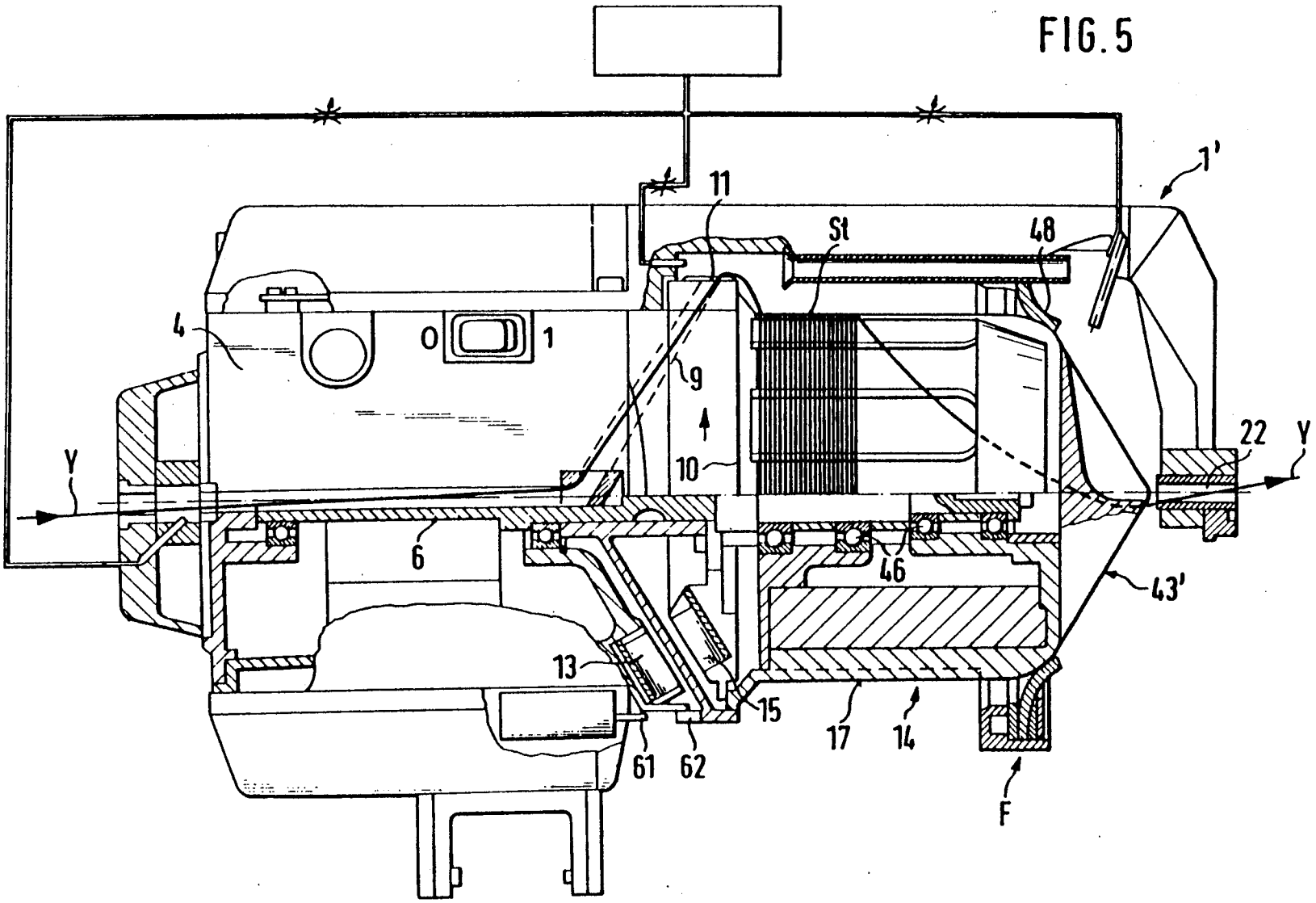
FIG. 5 shows the embodiment of FIGS. 2 and 3 in operation.

FIG. 5 depicts the normal operation of the yarn storing and delivering device 1' according to FIGS. 2 and 3. The properly threaded yarn Y extending through guide opening 22 passes underneath the brake elements 48 on the free edge 18 of storing surface 17. The feeder element 9 has been rotated together with hollow shaft 6 to form a yarn supply St consisting of a plurality of windings, from which the yarn may by withdrawn through guide opening 22 at a constant tension maintained by the braking action of the braking elements.

If a yarn breakage occurs between a (not shown) supply spool and the feeder element 9, the likewise not shown yarn breakage monitor acts to stop the motor 4 and the textile machine downstream of the storing and delivering device, whereupon the yarn supply St is removed as by manual intervention.

Subsequently a new leading yarn end is introduced into the hollow shaft 6 in the manner described above, and is then threaded by means of the compressed-air conveying system E explained above with reference to FIGS. 2 and 3, before motor 4 is again activated for forming a new yarn supply St. The yarn storing and delivering device 1' is then ready for further operation.

Figure 6:
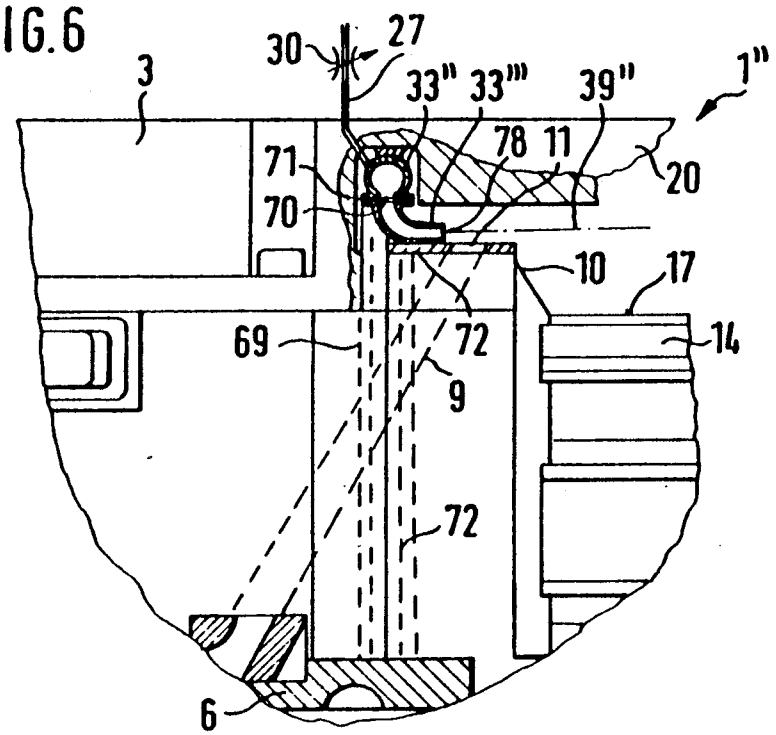
FIG. 6 shows a detail of a modification of the embodiment of FIG. 1.

Shown in FIG. 6 is a modified detail of a yarn storing and delivering device 1" substantially corresponding to the embodiment of FIG. 1. The modification is different therefrom in that the annular jet nozzle 33 forming the air curtain 39 is replaced by an annular jet nozzle body 33" concentrically surrounding ring 10 and secured to base body 3 or its arm 20, respectively, to cooperate with a directional jet nozzle 33''' secured to ring 10 for rotation therewith. Jet nozzle 33''' has a radially outwards directed inlet 70 and a nozzle opening 78 facing in the axial direction for generating an axial air jet 39" passing over outlet 11 of feeder element 9. Jet nozzle 33''' is fixedly connected to a cylindrical sealing ring 69 mounted for rotation around ring 10 concentric with the axis of hollow shaft 6 and forming a continuous sealing surface interrupted only at the location of inlet 70. Annular jet nozzle body 33" is provided with a circumferentially extending nozzle opening 72 facing radially inwards. Annular jet nozzle body 33" is further formed with a sealing surface 71 extending closely adjacent seal ring 69 along both sides of nozzle slot opening 72 and cooperating with seal ring 69 to form labyrinth-like seals for ensuring that the compressed air supplied to annular jet nozzle body 33" flows only into the inlet 70 of directional jet nozzle 33''' . Since nozzle slot opening 72 extends along the full circumference of annular jet nozzle body 33", it is ensured that directional jet nozzle 33''' is supplied with compressed air irrespective of the angular position whereat feeder element 9 is stopped after a yarn breakage, to thereby generate the air jet 39" conveying the yarn towards the air gap L not shown in FIG. 6. After passing air gap L the yarn enters air curtain 41 (FIG. 1) and is thereby conveyed towards guide opening 22.

FIG. 7 shows a modified embodiment of the guide opening 22 disposed on radial arm 21. In this embodiment guide opening 22 includes a suction jet nozzle 33 which may be employed with the embodiments of FIGS. 1, 2 and 6. An insert member defining guide opening 22 is surrounded by an annular chamber 74 having an outlet opening 77 adjacent the outlet opening 75 of the insert member defining guide opening 22. Annular chamber 74 communicates with the compressed-air source (not shown in this figure) via a supply tubing 76 and a valve 30 in such a manner that it constitutes an injector-type suction nozzle generating a suction air flow directed to the right in FIG. 7 for reliably pulling the conveyed yarn through guide opening 22.

Also indicated in FIG. 7 is an alternative embodiment of the first portion 49" of the guide channel of FIG. 2. The tube 52' with its longitudinal slot 54 has its end portion 55' arcuately bent in the direction towards channel 56, so that guide surface 51 is of arcuate configuration. Directional jet nozzle 37" is integrated into end portion 55' of tube 52" in such a manner that its air jet 41" impinges on the yarn before it leaves tube 52". The arcuate end portion 55' of tube 52" preferably terminates a short distance forwards of the ends of brake elements 48 so as not to interfere with the balloon-formation of the withdrawn yarn during normal operation of the device.

The flow or pressure control valves 30 permit the air jets of the individual jet nozzles to be accurately adjusted as to their intensity, so that the effect of one air jet is sufficiently reduced when the next air jet starts to act on the yarn. The control valves 30 also permit the compressed air conveying system to be adjusted to different types of yarns. The orientation of the directional jet nozzles is preferably also adjustable, although the jet nozzles are depicted as being non-adjustable in the figures. It is also possible to provide a greater number of directional jet nozzles than the numbers thereof shown in the drawings, in order to convey the yarn towards guide opening 22 by a relay of sequential compressed-air pulses. In the embodiment of FIG. 1, the closure cover 23 may also be employed as an auxiliary means for guiding the compressed-air flow. To this purpose it may be formed with air outlets adjacent guide opening 22 to thereby achieve accurate guidance of the air flow towards the guide opening.

We claim:

1. A yarn storing and delivering device for a textile machine, comprising a stationary base body, a hollow shaft rotatably mounted in said base body and carrying a laterally projecting yarn feeder element for tangentially winding the yarn guided into said hollow shaft on a storing surface of a storing drum, means for keeping said storing drum stationary relative to said base body, said storing surface having a free edge, said yarn feeder element having an outlet which permits said yarn to exit therefrom, said yarn being axially withdrawn from said storing drum over the free edge of said storing surface and through a substantially central guide opening, and a threading device for automatically threading said yarn up to a location within said guide opening, characterized in that said threading device between a location adjacent the outlet of said yarn feeder element and said guide opening comprises a compressed air conveying system including a plurality of stationary directional jet nozzles which when activated deliver said yarn to said guide opening by means of an air flow.

2. A yarn storing and delivering device according to claim 1, wherein a circumferential air gap is formed between said storing surface and a yarn withdrawal length measuring apparatus surrounding said storing drum in spaced relation thereto, characterized in that said plurality of stationary directional jet nozzles comprises a plurality of stationary annular jet nozzle bodies disposed concentric with said storing drum, which when activated generate an air flow curtain surrounding said storing surface and converging in the shape of a funnel towards said guide opening.

3. A yarn storing and delivering device according to claim 2, characterized in that each annular jet nozzle body has a circumferentially continuous slot nozzle or a circumferential row of jet nozzle openings.

4. A yarn storing and delivering device according to claim 1, characterized in that said storing drum includes a head portion facing towards said guide opening and provided with at least one guide surface for the air flow and said yarn.

5. A yarn storing and delivering device according to claim 4, characterized in that within said head portion of said storing drum there is further provided a central jet nozzle directed towards said guide opening.

6. A yarn storing and delivering device according to claim 1, characterized in that said storing drum includes a head portion of rotation-symmetric shape converging towards an apex point in a trapezoidal, triangular or concave configuration as seen in longitudinal section.

7. A yarn storing and delivering device according to claim 1, characterized in that there is provided a guide surface for said air flow and said yarn extending approximately parallel to the storing drum axis.

8. A yarn storing and delivering device according to claim 1, characterized in that said plurality of stationary directional jet nozzles includes first and second annular jet nozzle bodies mounted respectively at the side of the outlet of said feeder element facing away from said storing surface and at the lever of said free edge at fixed positions relative to said base body, the blowing direction of said first annular jet nozzle body being oriented approximately coaxially with the storing drum axis, and that of said second annular jet nozzle body, approximately radially.

9. A yarn storing and delivering device according to claim 1, wherein a circumferential air gap is defined between said storing surface and a yarn withdrawal length measuring apparatus surrounding said storing drum in spaced relation thereto, characterized in that said plurality of stationary directional jet nozzles includes a stationary annular jet nozzle body concentric with said storing drum and provided adjacent said feeder element outlet, said compressed air conveying system also including a directional jet nozzle having a radial inlet and an axially oriented nozzle opening and being provided for rotation in unison with said feeder element, the inlet of said directional jet nozzle being directed towards a radial outlet of said annular jet nozzle body formed as a circumferential slot, the nozzle opening of said directional jet nozzle lying at the side of said feeder element outlet facing away from said storing drum, and said directional jet nozzle being seated in a cylindrical sealing ring mounted concentric with the axis of rotation of said feeder element immediately adjacent a circumferential sealing surface of said annular jet nozzle body and containing an opening which adjoins said inlet of said directional jet nozzle.

10. A yarn storing and delivering device according to claim 9, characterized in that said plurality of stationary directional jet nozzles includes at least one further annular jet nozzle body disposed between said first-mentioned annular jet nozzle body and said yarn withdrawal length measuring apparatus with its blow direction oriented into said air gap.

11. A yarn storing and delivering device according to claim 1, wherein stop means is provided for stopping said feeder element always in the same predetermined angular position, characterized in that said stationary compressed-air directional jet nozzles are formed as individual directional jet nozzles of limited width in the circumferential direction of said storing drum and disposed one behind the other in a longitudinal section of the storing device towards which said outlet of said feeder element is directed in said predetermined angular position.

12. A yarn storing and delivering apparatus according to claim 11, characterized in that there is provided within said longitudinal section a guide channel including first and second members formed with guide surfaces and aligned with one another during the threading operation, said individual directional jet nozzles being directed into said guide channel, said first member of said guide channel having an open side and extending approximately parallel with the storing drum axis from adjacent said outlet of said feeder element to a location adjacent said free edge of said storing surface, while said second member of said guide channel extends radially from said free edge of said storing surface to a location adjacent said guide opening.

13. A yarn storing and delivering device according to claim 12, characterized in that said first member is a longitudinally slotted tube with a longitudinal slot directed radially with respect to said storing surface.

14. A yarn storing and delivering device according to claim 13, characterized in that adjacent an end of said first member of said guide channel there is provided one of said individual directional jet nozzles directed towards the free edge of said storing surface in a substantially radial direction.

15. A yarn storing and delivering device according to claim 13, characterized in that said tube has an end facing away from said feeder element outlet and bent towards said second member of said guide channel.

16. A yarn storing and delivering device according to claim 12, characterized in that said first member with a longitudinal slot opening approximately tangential to said storing surface in the direction of rotation of said feeder element, said slot having an edge located adjacent to said storing surface and defining at least one bevelled or rounded yarn deflector surface along which said yarn is automatically deflected out of said sleeve by a traction force towards said guide opening.

17. A yarn storing and delivering device according to claim 12, characterized in that said first member is formed with an insertion funnel facing said outlet of said feeder element.

18. A yarn storing and delivering device according to claim 12, wherein adjacent said free edge of said storing surface there is provided a yarn brake ring engaging said storing drum through resilient brake elements, characterized in that said first member of said guide channel extends axially through said yarn brake ring, and that between said brake elements there is maintained a circumferential gap aligned with the open side of said first member.

19. A yarn storing and delivering device according to claim 12, characterized in that said second member of said guide channel is formed as a channel member extending in a radial direction with a gradual transition towards said guide opening and open in the direction towards said guide opening, said channel member being formed with a restricted rim portion adjacent said storing drum and provided with a funnel-shaped inlet portion.

20. A yarn storing and delivering device according to claim 19, characterized in that said inlet portion of said channel member extends to a location at the side of said free edge and said brake elements facing towards said feeder element.

21. A yarn storing and delivering device according to claim 12, characterized in that a first said individual directional jet nozzle is disposed at the side of said outlet of said feeder element lying opposite said storing surface so as to be oriented approximately axially into said first member of said guide channel, and that adjacent or within an end of said first member of said guide channel there is provided a second said individual directional jet nozzle directed substantially radially into said second member of said guide channel.

22. A yarn storing and delivering device according to claim 1, wherein adjacent said free edge of said storing surface there is provided a yarn brake ring supported on said base body and formed with resilient brake elements adapted to engage said free edge, characterized in that said yarn brake ring is mounted for axial displacement relative to said storing drum to thereby form a gap between said brake elements and said storing drum.

23. A yarn storing and delivering device according to claim 1, characterized in that within or adjacent said guide opening there is provided an axial injector-type suction nozzle operated with compressed air from a compressed-air source.

24. A yarn storing and delivering device according to claim 1, characterized in that said directional jet nozzles are connected to a common compressed-air source through supply tubings, and that a separate pressure or flow control valve is provided for each directional jet nozzle.

* * * * *

UNITED STATES PATENT AND TRADEMARK OFFICE

CERTIFICATE OF CORRECTION

PATENT NO. : 5 094 275

DATED : March 10, 1992

INVENTOR(S) : Henry Shaw et al

It is certified that error appears in the above-identified patent and that said Letters Patent is hereby corrected as shown below:

On the title page, , please delete;

Item "[22] Filed: May 18, 1990", and add the following PCT information:

| | | |
|---|---|---|
| [22] | PCT Filed: | **Sep. 21, 1988** |
| [86] | PCT No.: | **PCT/EP88/00856** |
| | § 371 Date: | **May 18, 1990** |
| | § 102(e) Date: | **May 18, 1990** |
| [87] | PCT Pub. No.: | **WO89/02944** |
| | PCT Pub. Date: | **Apr. 6, 1989** |

Column 15, line 6; change "lever" to ---level---.

Signed and Sealed this

Twenty-sixth Day of October, 1993

*Attest:*

Bruce Lehman

BRUCE LEHMAN

*Attesting Officer*

*Commissioner of Patents and Trademarks*